US007494329B2

(12) United States Patent
Yoo et al.

(10) Patent No.: US 7,494,329 B2
(45) Date of Patent: Feb. 24, 2009

(54) OIL PUMP FOR A COMPRESSOR

(75) Inventors: Byoung Kil Yoo, Seoul (KR); Seung Yup Kim, Suwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/604,879

(22) Filed: Nov. 28, 2006

(65) Prior Publication Data

US 2007/0160489 A1 Jul. 12, 2007

(30) Foreign Application Priority Data

Nov. 28, 2005 (KR) ..... 10-2005-0113933

(51) Int. Cl.
*F04C 15/00* (2006.01)
*F04C 27/02* (2006.01)

(52) U.S. Cl. ..... 418/88; 418/15; 418/55.6; 418/94; 418/171; 418/270; 184/6.16; 184/6.18

(58) Field of Classification Search ..... 418/15, 418/55.1–55.6, 57, 88, 94, 171, 270, DIG. 1; 184/6.16–6.18, 6.23
See application file for complete search history.

(56) References Cited

U.S. PATENT DOCUMENTS 3,796,522 A * 3/1974 Oshima et al. ..... 418/15
5,775,120 A * 7/1998 Inazuka et al. ..... 62/259.1
5,775,123 A * 7/1998 Wakayama et al. ..... 62/407
5,947,373 A * 9/1999 Saito et al. ..... 165/240
6,050,794 A * 4/2000 Noboru et al. ..... 418/55.6
6,182,460 B1 * 2/2001 Hernandez et al. ..... 62/262
6,374,492 B1 * 4/2002 Myung et al. ..... 29/890.03
6,412,298 B2 * 7/2002 Kang et al. ..... 62/262
6,588,228 B2 * 7/2003 Choi ..... 62/426
6,772,601 B1 * 8/2004 Davis et al. ..... 62/187
6,868,681 B2 * 3/2005 Woo et al. ..... 62/175
6,951,628 B2 * 10/2005 Eidam et al. ..... 264/401
6,955,064 B2 * 10/2005 Lee et al. ..... 62/453
6,962,058 B2 * 11/2005 Kim et al. ..... 62/175
7,032,404 B2 * 4/2006 Kim et al. ..... 62/262
7,036,331 B2 * 5/2006 Kim ..... 62/262
7,055,338 B2 * 6/2006 Ergarac et al. ..... 62/228.1
7,082,776 B2 * 8/2006 Shin ..... 62/186
7,114,345 B2 * 10/2006 Kim et al. ..... 62/296
7,121,106 B2 * 10/2006 Jung et al. ..... 62/324.6

FOREIGN PATENT DOCUMENTS

JP 04334701 A * 11/1992 ..... 418/94
JP 05240170 A * 9/1993 ..... 418/55.6
JP 05272473 A * 10/1993 ..... 418/55.6
JP 07324695 A * 12/1995

* cited by examiner

*Primary Examiner*—Theresa Trieu
(74) *Attorney, Agent, or Firm*—Ked & Associates, LLP

(57) ABSTRACT

An oil pump for a compressor is provided. The oil pump includes a pump body coupled to a driving shaft, and a pumping member coupled to the pump body so as to define a pumping part and a pump cover is coupled to a lower side of the pump body therebetween. A lower suction unit provided at a lower side of the pump body draws fluid into the pump from a lower portion of a supply area, and an upper suction unit draws fluid into the pump from an upper portion of the oil supply area.

32 Claims, 10 Drawing Sheets

OIL PUMP FOR A COMPRESSOR

BACKGROUND

1. Field

This relates to an oil pump, and more particularly, to an oil pump for a compressor.

2. Background

In general, a compressor converts mechanical energy into compressive energy. Compressors may typically be categorized into a reciprocating type, a scroll type, a centrifugal type and a vane type. Scroll compressors are commonly used in air conditioning and refrigeration applications. Scroll compressors may be further divided into a low-pressure type scroll compressor or a high-pressure type scroll compressor based on whether a casing of the scroll compressor is filled with a suction gas or a discharge gas. The above references are incorporated by reference herein where appropriate for appropriate teachings of additional or alternative details, features and/or technical background.

BRIEF DESCRIPTION OF THE DRAWINGS

The embodiments will be described in detail with reference to the following drawings, in which like reference numerals refer to like elements, wherein.

DETAILED DESCRIPTION

Figure 1:
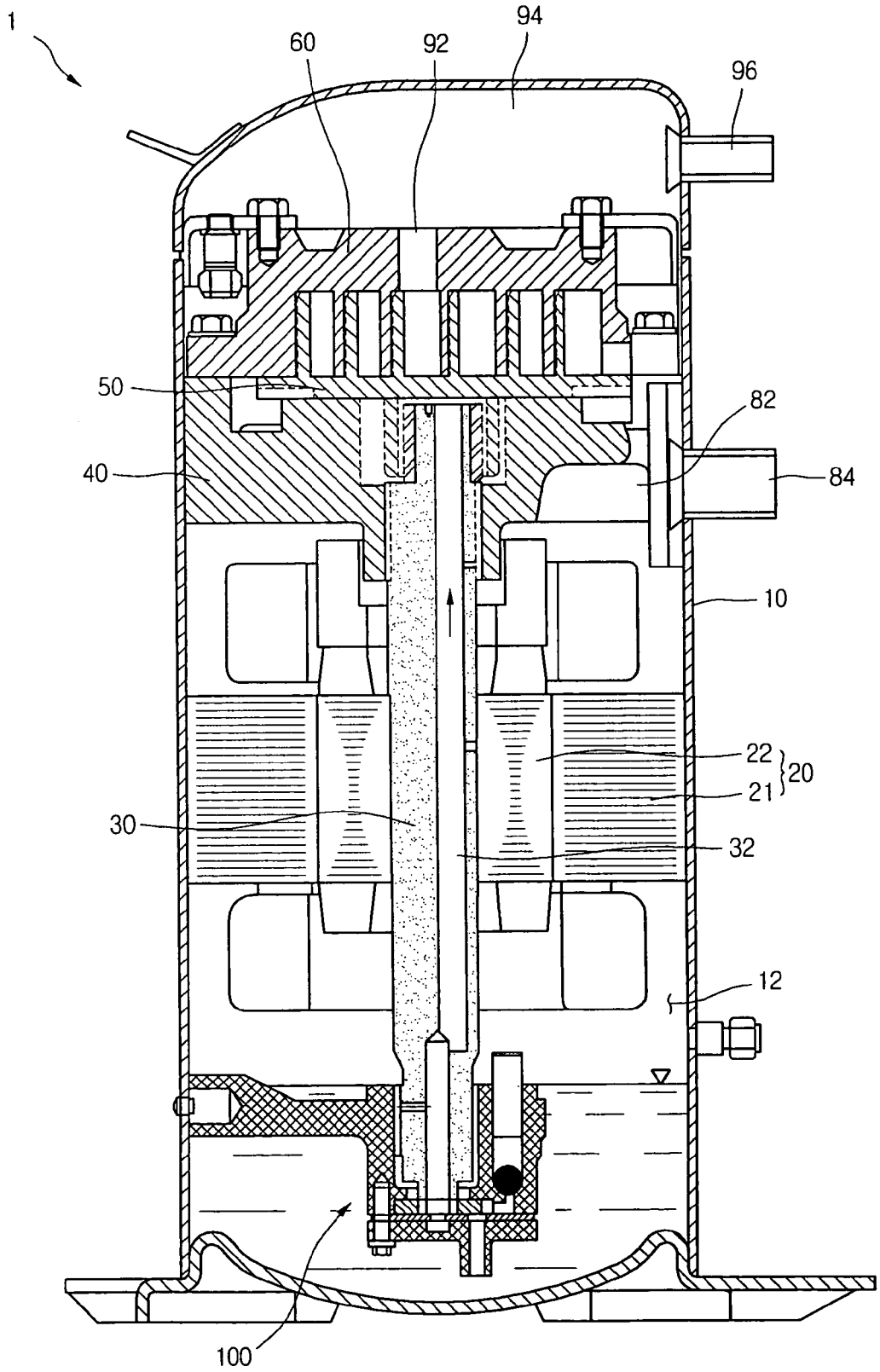
FIG. 1 is a cross sectional-view of an exemplary scroll compressor having an oil pump in accordance with embodiments as broadly described herein.

As shown in FIG. 1, a scroll compressor 1 having an oil pump in accordance with embodiments as broadly described herein. Although a scroll compressor 1 is presented for ease of discussion, it is well understood that an oil pump as embodied and broadly described herein may be applied to other types of compressors and/or other applications which require fluid pumping as described herein. The exemplary compressor 1 includes a casing 10, a drive portion provided inside of the casing 10 to generate a rotary force, a suction portion which introduces fluid from the outside, a scroll compression portion which compresses the fluid, a discharge portion which discharges high-pressure fluid compressed by the scroll compression portion, and an oil pump 100 which supplies oil to the friction parts of the compressor 1, such as, for example the components of the scroll compression portion.

The drive portion may include a drive motor 20 with a stator 21 and a rotor 22, and a drive shaft 30 which rotates at the center of the drive motor 20. The oil pumped by the oil pump 100 flows up to an upper portion of the compressor 1 through supply passages 32 which pass through the drive shaft 30.

The suction portion may include a suction pipe 84 which extends through an outer wall of the casing 10, and a suction chamber 82 which may be connected to the suction pipe 84 so as to accumulate refrigerant introduced into the compressor 1 through the suction pipe 84.

The scroll compression portion may include an upper frame 40 which supports an upper end of the drive shaft 30, an orbiting scroll 50 provided on an upper side of the upper frame 40 for compressing refrigerant introduced through the suction pipe 84, and a fixed scroll 60 provided on an upper side of the upper frame 40. In certain embodiments, the fixed scroll 60 may be fixed to the upper frame 40 so as to be interengaged with the orbiting scroll 50.

The discharge portion may include a discharge port 92 provided proximate a center of the fixed scroll 60, a discharge chamber 94 in communication with the discharge port 92, and a discharge pipe 96 in communication with the discharge chamber 94. The discharge port 92 discharges compressed refrigerant from the scrolls 50, 60 into the discharge chamber 94, where it is then discharged to outside the compressor 1 through the discharge pipe 96.

The oil pump 100 may be located at a lower portion of the inside of the compressor 1, as shown in FIG. 1. Other locations may also be appropriate, based on the relative arrangement of the other components of the compressor 1. The oil pump 100 pumps oil and other fluids stored in a storage area 12 in response to a rotation of the driving shaft 30. In certain embodiments, the oil pump 100 is configured to take in fluids stored in the storage area 12 from multiple intake ports. This may be accomplished by, for example, providing an upper suction unit and a lower suction unit at upper and lower portions of the oil pump 100 (to be described later). Other arrangements may also be appropriate.

Figure 2:
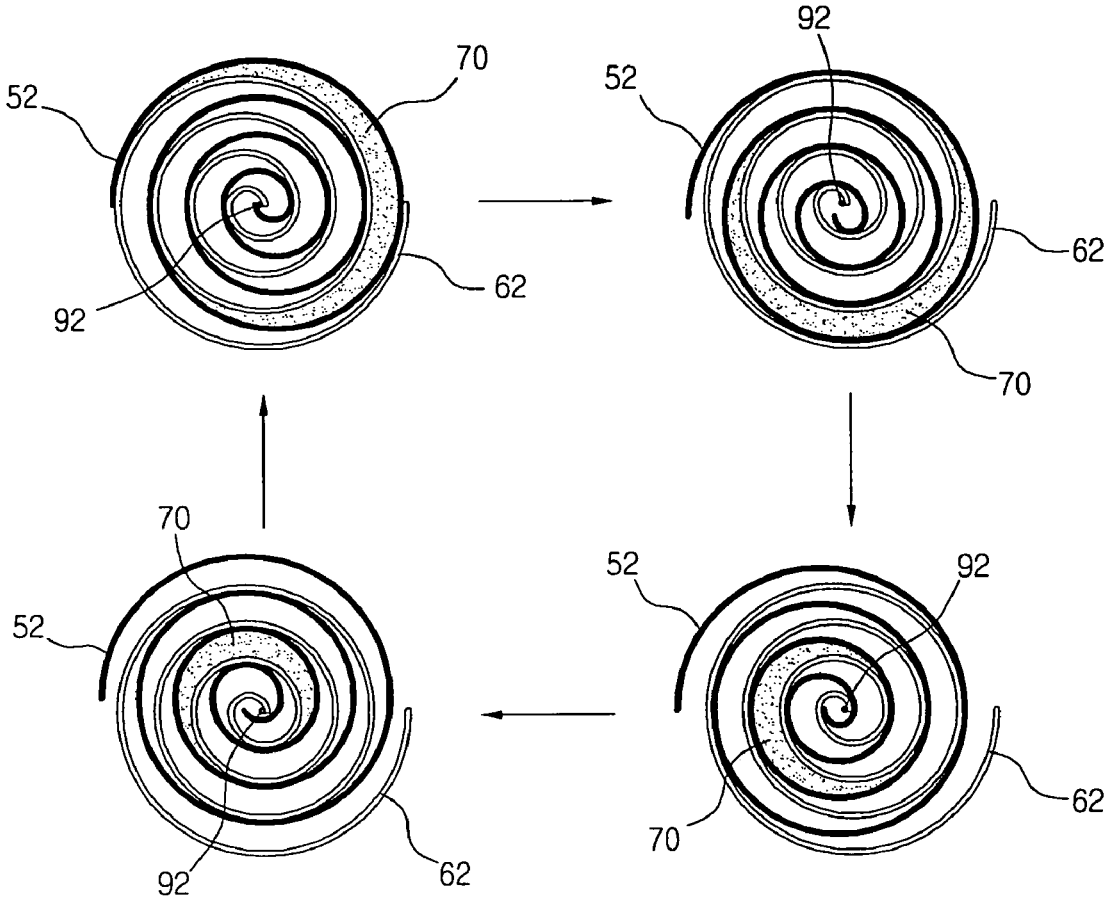
FIG. 2 is a plan view illustrating a compression process of refrigerant in an exemplary scroll compressor in accordance with embodiments as broadly described herein.

Referring to FIG. 2, the exemplary scroll compression portion may include a fixed scroll wrap 62 formed in a spiral shape on the lower side of the fixed scroll 60, and an orbiting scroll wrap 52 formed in a spiral shape on the upper side of the orbiting scroll 50 and 180° counter-inserted with the fixed scroll wrap 62. The discharge port 92 is formed at the inside center of the fixed scroll wrap 62. A refrigerant compression process in this exemplary scroll compression portion with the said composition is described below.

First, the orbiting scroll 50 is eccentrically rotated centering around the drive shaft 30. A pocket 70 is formed by the surface contact between the wraps 52, 62 as the orbiting scroll 50 revolves against the fixed scroll 60 due to the rotation of the drive shaft 30. This pocket 70 causes compression of the refrigerant. More specifically, the volume of the pocket 70 gets smaller as it approaches the center part of the scroll wraps 52, 62 as the orbiting scroll wrap 52 rotates, and a high pressure is generated as the volume decreases. The high pressure fluid then flows to the discharge chamber 94 through the discharge port 92 located on the center part of the scroll compression portion.

Operation of the exemplary compressor 1 in accordance with embodiments as broadly described herein will now be described.

When the compressor 1 is operated, refrigerant is introduced into the compressor 1 through the suction pipe 84. If the compressor 1 is operated in a low temperature heating condition, low-temperature liquid refrigerant is introduced through the suction pipe 84. Then, a portion of the refrigerant flows into the scroll compression portion, and in particular, the scroll wraps 52, 62 via the suction chamber 82, and the remaining portion of the refrigerant is stored in the storage area 12.

The portion of the refrigerant which has been directed to the scroll compression portion is compressed under high pressure by the orbiting operation of the orbiting scroll 50 as previously discussed, and the compressed refrigerant gathers at the center of the scrolls 50, 60. The gathered high-pressure refrigerant flows to the discharge chamber 94 through the discharge port 92. The refrigerant accumulated in the discharge chamber 94 is the discharged to the outside through the discharge pipe 96. The oil accumulated in the storage area 12 is drawn into the oil pump 100 and flows up through the passages 32 in the inner part of the drive shaft 30 as the oil pump 100 operates due to the rotation of the drive shaft 30 during a compression operation.

The refrigerant, which has a relatively heavier specific gravity than the oil, accumulates at a lower portion of the supply area 12, and the oil, which has a relatively lighter specific gravity than the refrigerant, accumulates at an upper portion of the storage area 12. Thus, the low temperature refrigerant and the oil stored in the storage area 12 are not mixed, but instead are phase-separated from each other when the compressor 1 operates in a low temperature heating condition. In this situation, the refrigerant is drawn into the pump 100 by a lower suction unit, and the oil is drawn into the pump 100 by an upper suction unit. In this manner, oil may be supplied to the friction parts of the compressor 1, even though the refrigerant and oil stored in the storage area 12 are phase-separated from each other.

Figure 3:
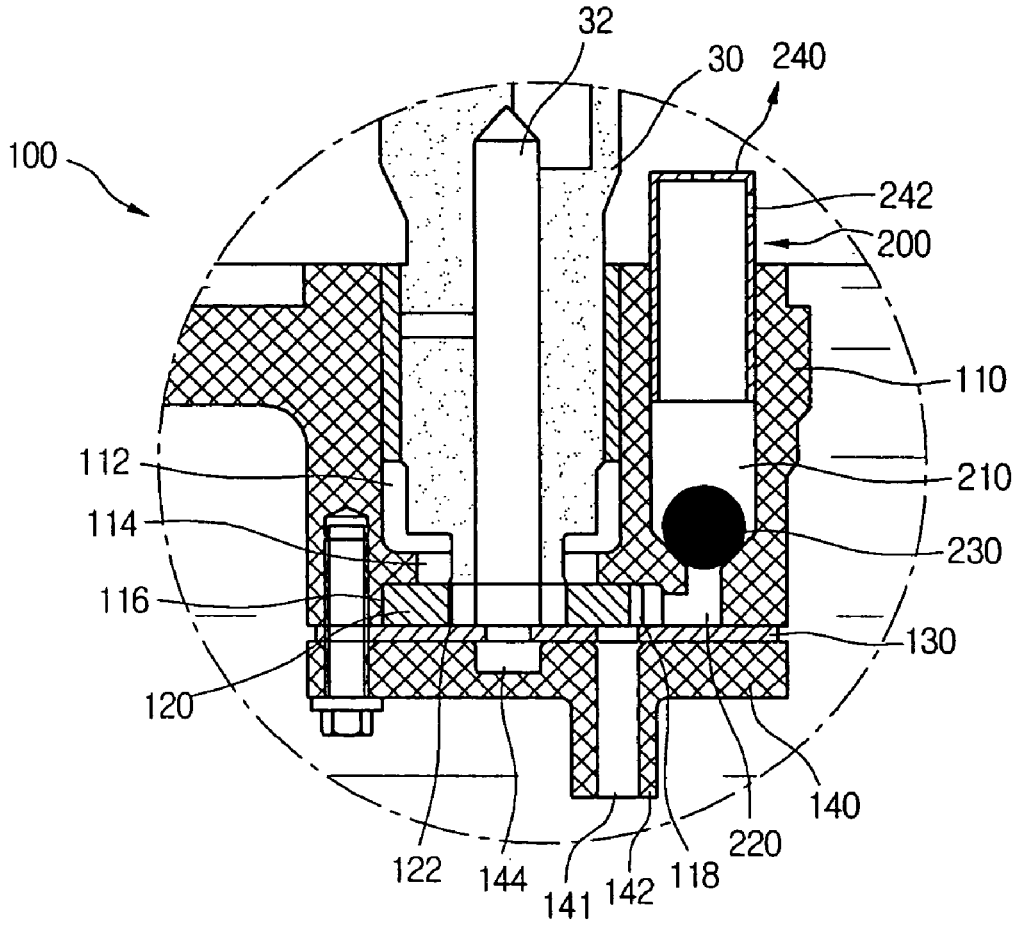
FIG. 3 is a cross-sectional view of an oil pump in accordance with an embodiment as broadly described herein.

FIG. 3 is a cross-sectional view of an oil pump in accordance with embodiments as broadly described herein. The oil pump 100 may include a lower frame 110 into which the drive shaft 30 may be inserted, a pumping member 120 provided at a lower portion of the lower frame 110 and coupled to the lower end of the drive shaft 30, a plate 130 positioned on the lower side of the lower frame 110 to guide the inflow and discharge of fluids, and a pump cover 140 positioned on the lower side of the plate 130.

The lower frame 110 essentially forms a pump body of the oil pump 100. A drive shaft insertion groove 112 may be formed in the lower frame 110 to receive the drive shaft 30. A driving shaft penetrating hole 114 may be formed proximate the bottom of the driving shaft insertion groove 112.

A pumping member insertion groove 116 may be formed on the lower side of the lower frame 110 so as to receive the pumping member 120 therein. This allows the drive shaft 30 and the pumping member 120 to be coupled within the lower frame 110 by the driving shaft insertion groove 112, driving shaft penetrating hole 114, and pumping member insertion groove 116.

An oil pumping part 118 which pumps oil may be provided between an inner circumferential surface of the pumping member insertion groove 116 and the pumping member 120. Therefore, when oil flows into the pumping unit 118, the oil flows upwards and along the drive shaft 30 along a predetermined flowpath due to the rotation of the pumping member 120.

An upper suction unit 200 may be provided proximate an upper portion of the lower frame 110. The upper suction unit 200 draws fluid stored in the upper portion of the storage area 12 into the oil pump 100. The upper suction unit 200 may include a suction passage 210 which extends downwardly from the upper portion of the lower frame 110, and a supply passage 220 which supplies oil to the pumping part 118. In the embodiment shown in FIG. 3, a width of the supply passage 220 is smaller than a width of the suction passage 210. These widths may be adjusted as necessary based on the requirements of a particular application. The upper suction unit 200 may also include an opening and shutting member 230, or valve, which opens and shuts the supply passage 220, and a cover 240 inserted into the suction passage 210 from the upper end of the suction passage 210, the cover 240 having a plurality of upper intakes 242, or apertures, formed therein.

The cover 240 may be forcibly coupled, or press fit, to the upper suction unit 210. The cover 240 may have a predetermined length, and the height of the upper intake 242 may be controlled based on a degree of insertion of the cover 240 into the suction passage 210.

The upper intake 242 may be formed in the upper side of the cover 240, as shown, for example, in FIG. 3, or in other locations as appropriate. Likewise, a shape of the upper intake 242 may be varied as necessary. Oil accumulated in the upper portion of the supply area 12 when a low temperature refrigerant and oil stored in the storage area 12 are phase-separated, or not mixed, is drawn into the oil pump 100 through the upper intake 242. The refrigerant, which has a relatively heavier specific gravity than the oil, is accumulated in the lower portion of the supply area 12, and the oil, which has a relatively lighter specific gravity than the refrigerant, is accumulated in the upper portion of the supply area 12 as the compressor 1 operates in a low temperature heating condition The opening and shutting member 230, or valve, may be positioned within the supply passage 220 so as to selectively open and shut the supply passage 220. The opening and shutting member 230 is shown as a ball positioned in an upper portion of the supply passage 220, where it meets the suction passage 210. However, other mechanisms, or valves, and placements thereof within the supply passage 220 and/or suction passage 210 may also be appropriate. The specific gravity of the opening and shutting member 230, an specifically of the ball in this particular example, is less than that of the oil. The opening and shutting member 230 so configured prevents refrigerant from being drawn into the oil pumping part 118 by shutting off the supply passage 220 when oil does not flow into the suction passage 210. In this particular example, when oil flows into the suction passage 210, the opening and shutting member 230 ascends within the suction passage 210 due to the difference in specific gravity, and opens the supply passage 220 to allow oil to be supplied to the oil pumping part 118.

A drive shaft insertion hole 122 into which the drive shaft 30 is inserted may be formed at the center of the pumping member 120, thus allowing the pumping member 120 to rotate with the rotation of the drive shaft 30. The pumping member 120 may be fixed to a side of the lower frame 110 such that, as the drive shaft 30 rotates while the pumping member 120 is fixed to a side of the lower frame 110, the pumping member 120 actually revolves about the drive shaft 30.

In certain embodiments, the plate 130 may have a substantially circular shape. The plate 130 may prevent direct friction between the pumping member 120 and the pump cover 140, and may help to guide the inflow of fluids.

A lower suction unit 142 may extend downwardly from a lower portion of the pump cover 140. The lower suction unit 142 may include an intake 141 which draws fluid stored in the storage area 12 into the pump 100. A discharge groove 144 may be formed as a recess in an upper side of the pump cover 140. The discharge groove 144 receives the inflow of fluids directed towards the drive shaft 30 as the pumping member 120 rotates.

Figure 4:
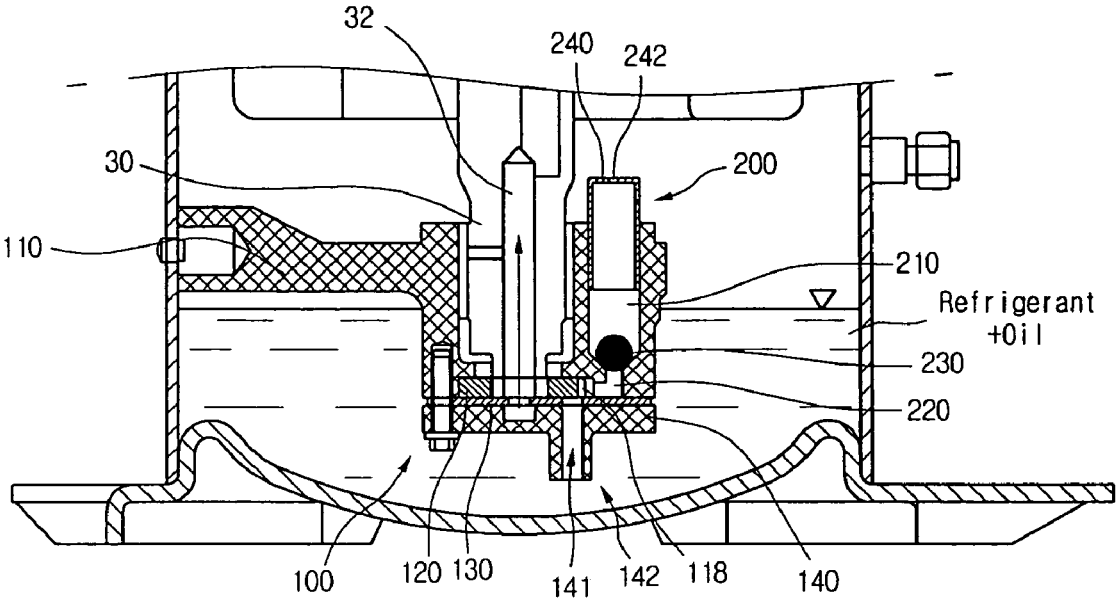
FIG. 4 illustrates the supplying of the oil through the oil pump shown in FIG. 3 in a state in which the refrigerant and oil are not separated from each other.
Figure 5:
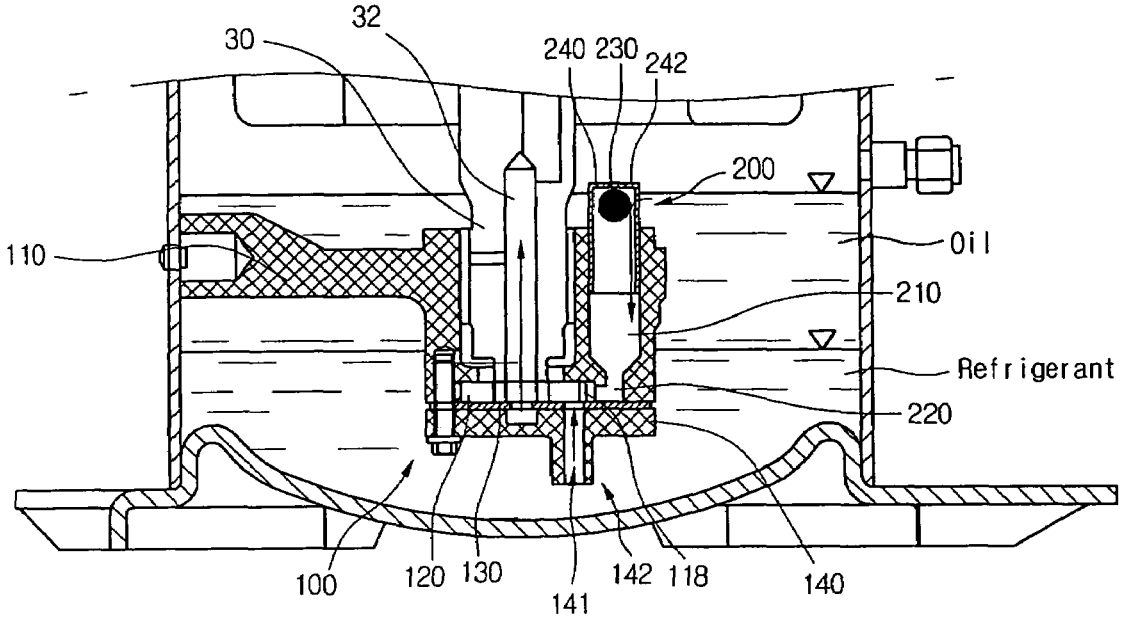
FIG. 5 illustrates the supplying of the oil through the oil pump shown in FIG. 3 in a state in which the refrigerant and oil are separated from each other.

A process by which an oil pump as embodied and broadly described herein will now be discussed. FIG. 4 illustrates the supplying of oil through the oil pump 100 in a state that the refrigerant and oil are mixed, and thus not separated from each other, and FIG. 5 illustrates the supplying of oil through the oil pump 100 in a state that the refrigerant and oil are separated from each other.

When the pumping member 120 rotates with the rotation of drive shaft 30 in a condition that the oil and refrigerant stored in the storage area 12 are mixed, and thus not separated from each other, the refrigerant and oil are drawn into the pump 100 through the lower suction unit 142 by the pressure difference generated by the rotation of the pumping member 120. The refrigerant and oil flows into the pumping part 118, and up through the shaft 30 after progressing through a predetermined pumping process. In this manner, suction of vapor refrigerant contained in the upper part of the storage area 12 into the oil pumping part 118 is prevented, as the opening and shutting member 230 closes off the supply passage 220.

In FIG. 4, the height of the mixture of the refrigerant and oil in the storage area 12 is shown below the height of the upper intake 242 of the upper suction unit 200. However, when the height of the mixture of the refrigerant and oil becomes higher than the height of the upper intake 242, the oil and refrigerant may be drawn into the pump 100 through the suction passage 210.

When the compressor 1 is operated in a low temperature heating condition, low temperature refrigerant and oil stored in the storage area 12 are not mixed, but rather phase-separated from each other, and the refrigerant, which has a relatively heavier specific gravity, is accumulated beneath the oil, which is relatively lighter and is thus accumulated above the refrigerant. If conditions in the supply area 12 are such that the height of the oil reaches the upper intake 242, the oil flows into the suction passage 210 through the upper intake 242. This causes the opening and shutting member 230 to ascend due to the relatively heavier specific gravity of the oil, and the supply passage 220 is opened. Then, the oil flows into the oil pumping part 118 through the supply passage 220 and undergoes a predetermined pumping process. In this situation, the refrigerant in the lower portion of the storage area 12 is drawn into the pump 100 through the lower suction unit 142.

An oil pump as embodied and broadly described herein allows for a continuous supply of oil to friction parts of the compressor, such as, for example, the components of the scroll compression portion, even though refrigerant and oil stored in the storage area 12 may be phase-separated from each other in a low temperature heating condition.

Further, abrasion and damage to the scroll compression portion and components thereof may be prevented as the scroll compression portion is lubricated with this continuous supply of oil, thus enhancing the reliability and operability of the compressor.

Figure 6:
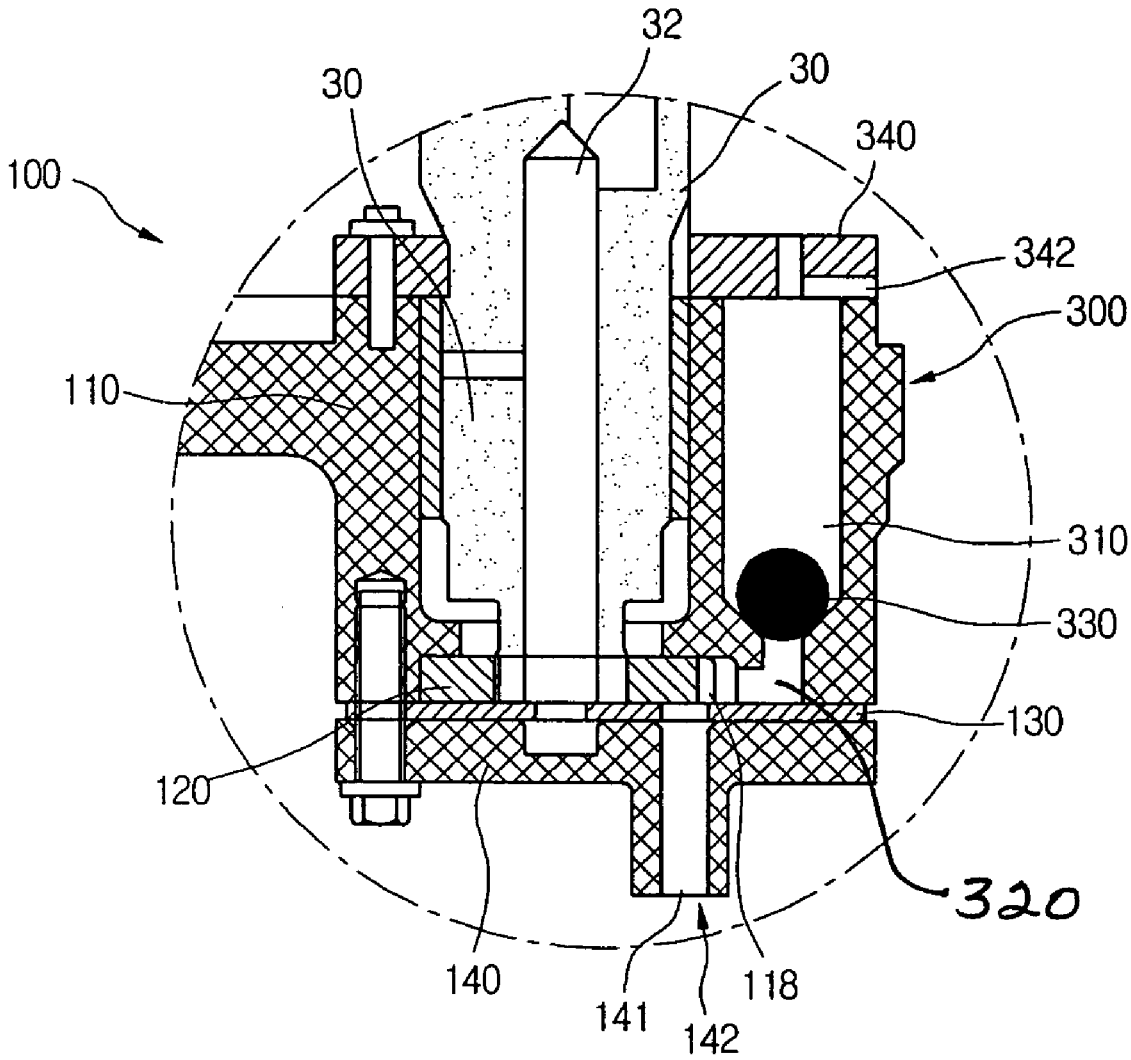
FIG. 6 is a cross sectional view of an oil pump in accordance with embodiment as broadly described herein.

Another embodiment will now be described with reference to FIG. 6. The oil pump 100 shown in FIG. 6 includes an upper oil suction unit 300 with a suction passage 310 extending downwardly from an upper portion of the lower frame 110, and a supply passage 320 which supplies oil from the suction passage 310 to the pumping part 118. A width of the supply passage 320 may be less than a width of the suction passage 310, as shown in FIG. 6. However, other relative sizes, shaped and orientations of these components may also be appropriate. The upper suction unit 300 may also include an opening and shutting member 330, or valve, which selectively opens and shuts the supply passage 320, and a cover 340 positioned on the upper portion of the lower frame 110, the cover 340 having a plurality of upper intakes 342. Particularly, the cover 340 may be assembled onto an upper side of the lower frame 110 using a variety of different attachment devices, including, for example, fasteners, welds and the like. The upper intakes 342 may penetrate the side(s) or top of the cover 340 as necessary. In this embodiment, the strength and durability of the cover 340 may be improved, and fabrication of the cover 340 is simplified when compared to force or press-fitting the cover 340 to the lower frame 110.

Figure 7:
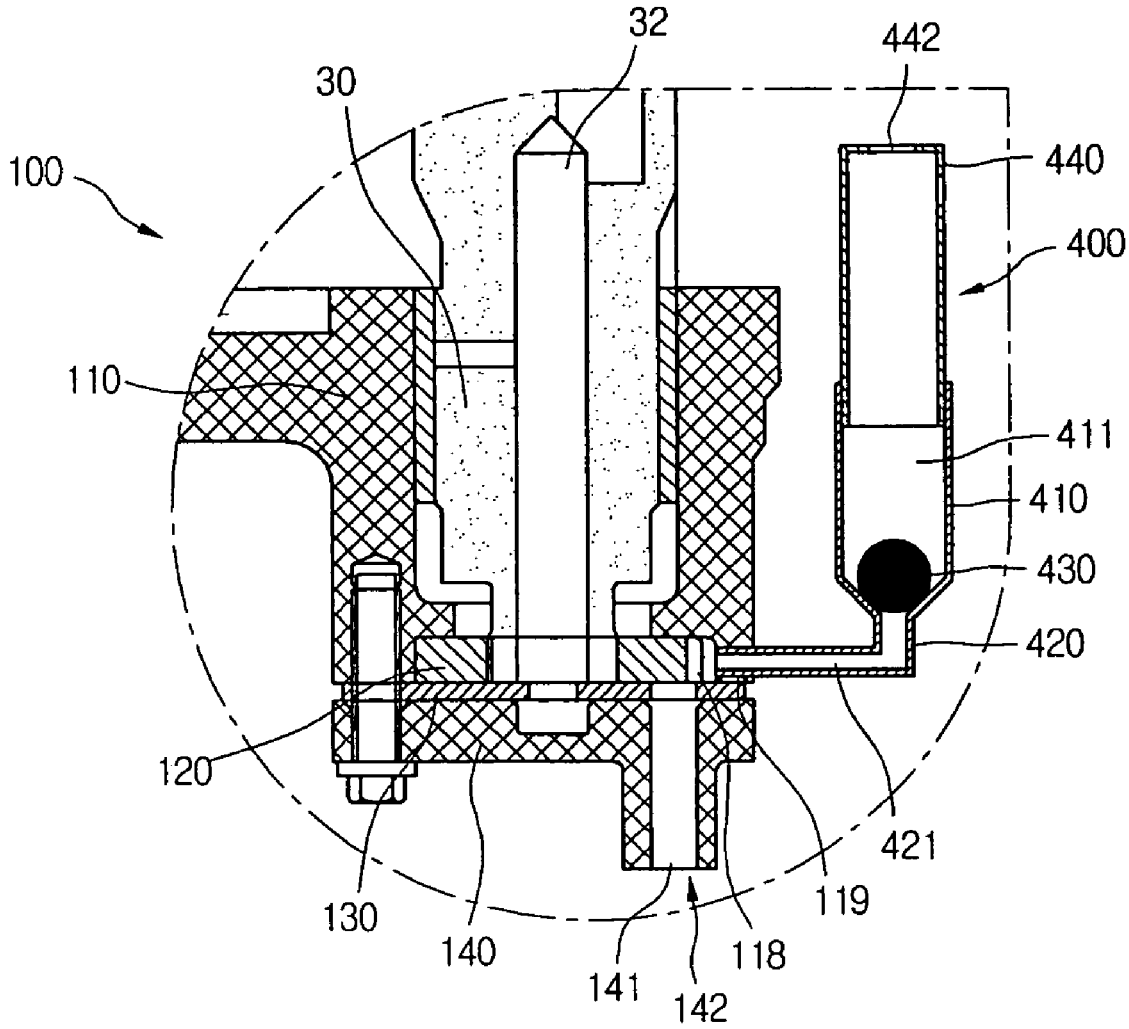
FIG. 7 is a cross sectional view an oil pump in accordance with an embodiment as broadly described herein.

Another embodiment will now be described with reference to FIG. 7. The oil pump 100 shown in FIG. 7 includes an upper suction unit 400 provided on a side of the lower frame 110. The upper suction unit 400 may include supply pipe 420 inserted into a side of the lower frame 110, the supply pipe 420 having a supply passage 421. The upper suction unit 400 may also include a suction pipe 410, which as shown in FIG. 7, may be larger than the supply pipe 420. Other relative sizes, shapes and orientations of these components may also be appropriate. The upper suction unit 400 may also include a suction passage 411, an opening and shutting member 430, or valve, which selectively opens and shuts the supply passage 421, and a cover 440 inserted into an upper end of the suction pipe 410, the cover 440 having several upper intakes 442. In alternative embodiments, the suction pipe 410 and cover 440 may be formed as a single unit to form the suction passage 411. In such embodiments, the upper intakes 442 may be formed in this single unit. An insertion hole 119 for inserting the supply pipe 420 may be formed in an appropriate portion of the lower frame 110 so as to connect the supply passage 421 to the pumping part 118. In these embodiments, the structure of the lower frame 110 may remain as previously discussed, and the upper suction unit 400 may be simply assembled by inserting the supply pipe 420 into the insertion hole 119.

Figure 8:
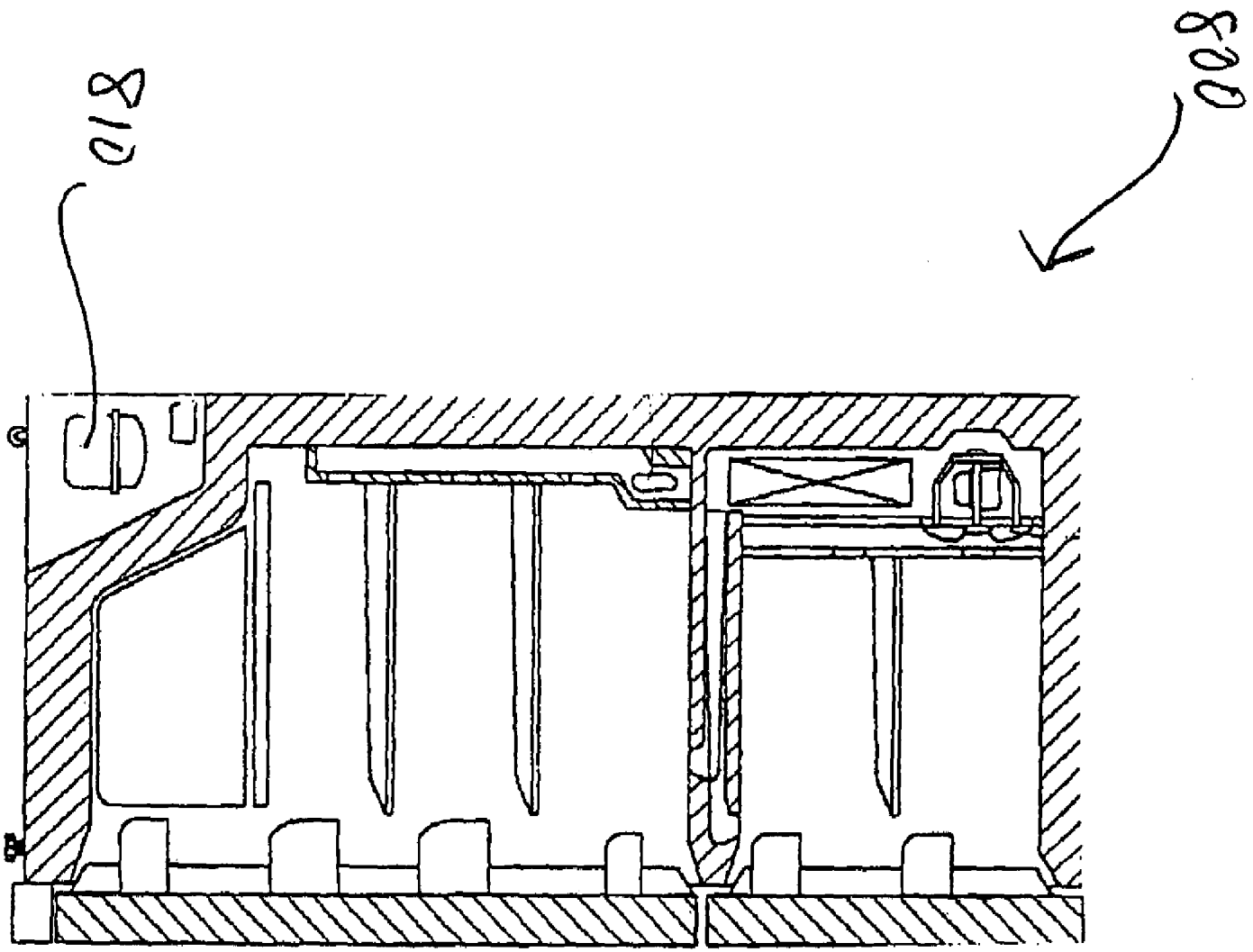
FIGS. 8-10 are exemplary installations of a compressor having an oil pump as embodied and broadly described herein.

The oil pump for a compressor as embodied and broadly described herein has numerous applications in which compression of fluids is required, and in different types of compressors. Such applications may include, for example, air conditioning and refrigeration applications. One such exemplary application is shown in FIG. 8, in which a compressor 810 having an oil pump as embodied and broadly described herein is installed in a refrigerator/freezer 800. Installation and functionality of a compressor in a refrigerator is discussed in detail in U.S. Pat. Nos. 7,082,776, 6,955,064, 7,114,345, 7,055,338 and 6,772,601, the entirety of which are incorporated herein by reference.

Figure 9:
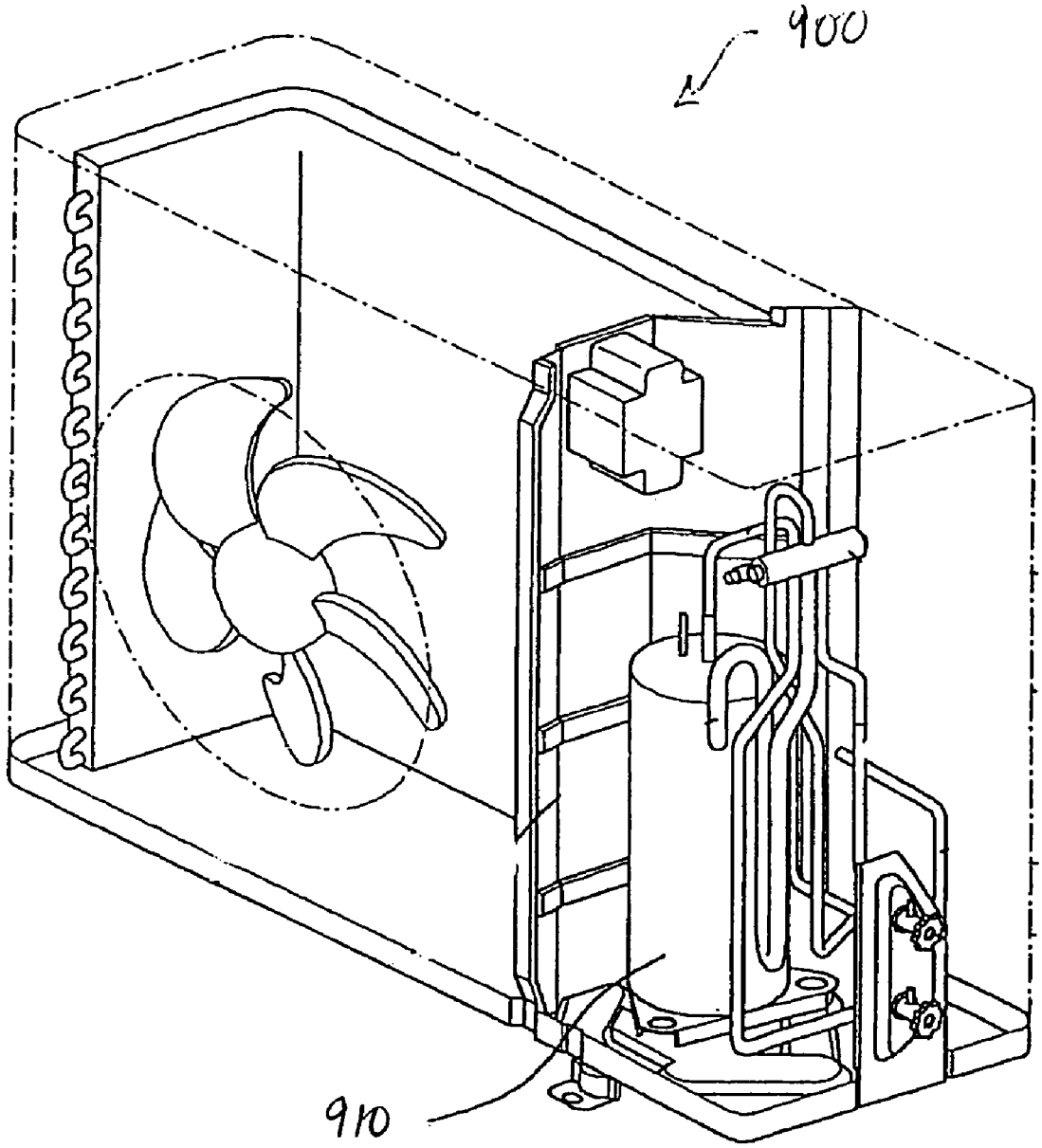

Another such exemplary application is shown in FIG. 9, in which a compressor 910 having an oil pump as embodied and broadly described herein is installed in an outdoor unit of an air conditioner 900. Installation and functionality of a compressor in a refrigerator is discussed in detail in U.S. Pat. Nos. 7,121,106, 6,868,681, 5,775,120, 6,374,492, 6,962,058, 6,951,628 and 5,947,373, the entirety of which are incorporated herein by reference.

Figure 10:
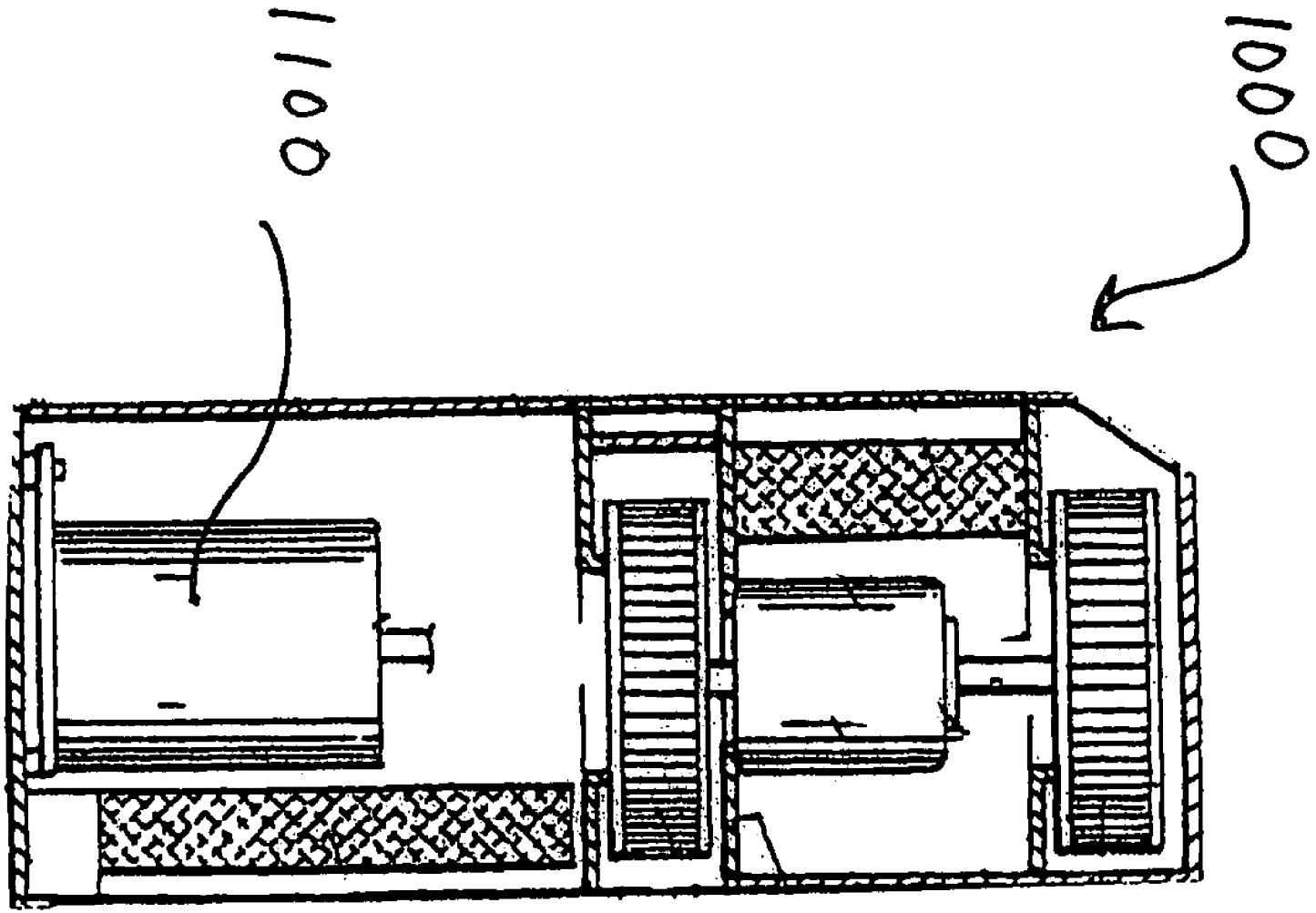

Another such exemplary application is shown in FIG. 10, in which a compressor 1100 having an oil pump as embodied and broadly described herein is installed in a single, integrated air conditioning unit 1000. Installation and functionality of a compressor in a refrigerator is discussed in detail in U.S. Pat. Nos. 7,032,404, 6,412,298, 7,036,331, 6,588,228, 6,182,460 and 5,775,123, the entirety of which are incorporated herein by reference.

Likewise, the oil pump as embodied and broadly described herein is not limited to installation in compressors. Rather, the oil pump as embodied and broadly described herein may be applied in any situation in which this type of fluid pumping is required and/or advantageous.

An object is to provide an oil pump for a scroll compressor capable of pumping oil when refrigerant and oil stored in a storage area of the compressor are phase-separated from each other in a low temperature heating condition.

Another object is to provide an oil pump for a scroll compressor capable of preventing abrasion and damage to friction parts of the compressor by supplying oil smoothly and continuously so as to lubricate the friction parts properly.

An oil pump for a scroll compressor in accordance with embodiments as broadly described herein includes a pump body coupled to a driving shaft, a pumping member located on the pump body and rotating with the driving shaft, an oil pumping part formed on between the pump body and the pumping member, a pump cover coupled to the lower side of the pump body and having a lower part oil suction unit, and an upper part oil suction unit placed on the upper part of the lower part oil suction unit and inhaling the oil.

Another oil pump for a scroll compressor in accordance with embodiments as broadly described herein includes a driving shaft, a pump body penetrating the driving shaft, a pumping member located on the pump body and rotated with the driving shaft, an oil pumping part formed on between the pumping member and the pump body; a lower part oil suction unit coupled to the lower side of the pump body and inhaling the oil to be supplied to the oil pumping part, and an upper part oil suction unit formed on the pump body and inhaling the oil to be supplied to the pumping unit.

Another oil pump for a scroll compressor in accordance with embodiments as broadly described herein includes a driving shaft, a pump body penetrating the driving shaft, a pumping member located on the pump body and capable of rotating by the driving shaft, an oil pumping part formed on between the pumping member and the pump body, a lower part oil suction unit coupled to the lower part of the pump body and supplying the oil to the oil pumping part, and an upper part oil suction unit coupled to a side of the pump body and supplying the oil to the oil pumping part.

In accordance with embodiments as broadly described herein it is possible that a mixture of refrigerant and oil is inhaled at lower and upper part suction units, respectively, in a condition that the refrigerant and oil are mixed in the oil storage.

In a case that the refrigerant and oil are phase-separated from each other as a temperature of the oil storage goes down due to a low temperature liquid refrigerant when the compressor is operated in a low temperature heating condition, pumping only refrigerant to the oil pumping part is prevented, and oil can be supplied continuously, as the lower oil suction unit inhales the refrigerant, and the upper oil suction unit inhales the oil.

Moreover, the operability, capacity and the reliability of the compressor are improved as the friction parts of the compressor are well lubricated by the smooth and continuous supply of oil.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An oil pump for a compressor including a casing having a fluid storage area formed therein, the oil pump comprising:

a pump body coupled to a drive shaft;

a pumping member coupled to the pump body so as to define a pumping part therebetween;

a pump cover coupled to a lower side of the pump body, the pump cover including a lower suction unit having at least one passage formed therein, wherein the lower suction unit draws in fluid stored in the storage area through the at least one passage formed therein; and an upper suction unit positioned above the lower suction unit, the upper suction unit having at least one passage formed therein, wherein the upper suction unit draws in fluid stored in the storage area through the at least one passage formed therein.

2. The oil pump of claim 1, wherein the upper suction unit and the lower suction unit each draw fluid in from a corresponding portion of the fluid storage area of the compressor, and direct the fluid towards the pumping member.

3. The oil pump of claim 2, wherein the fluid drawn in by the upper and lower suction units comprises oil, refrigerant, or a mixture thereof.

4. The oil pump of claim 1, wherein the upper suction unit is formed on the pump body.

5. The oil pump of claim 1, wherein the upper suction unit is mounted on a side of the pump body.

6. The oil pump of claim 1, wherein the upper suction unit includes:

a supply passage connected to the pumping part;

a suction passage which couples a fluid storage area of the compressor to the supply passage;

a cover configured to cover the suction passage, wherein the cover includes at least one intake; and an opening and shutting member configured to selectively open and shut the supply passage.

7. The oil pump of claim 6, wherein a cross sectional area of the suction passage is greater than a cross sectional area of the supply passage, and wherein the opening and shutting member comprises a ball valve positioned where the supply passage meets the suction passage, wherein a specific gravity of a ball portion of the ball valve is less than that of fluid to be drawn into the suction and supply passages so that the ball ascends into the suction passage as the fluid is drawn in.

8. The oil pump of claim 6, wherein the upper suction unit is configured to draw fluid from an upper portion of the fluid storage area in through the suction passage and to direct the fluid into the supply passage based on the selective positioning of the opening and shutting member.

9. The oil pump of claim 8, wherein the supply passage is configured to direct the fluid towards the pumping part.

10. The oil pump of claim 6, wherein the lower suction unit is configured to draw in fluid from a lower portion of the fluid storage area and to direct the fluid towards the pumping part.

11. The oil pump of claim 6, wherein the cover is configured to be inserted into the suction passage.

12. The oil pump of claim 6, wherein the cover is configured to be coupled to the pump body.

13. The oil pump of claim 6, wherein the opening and shutting member has a lighter specific gravity than that of a fluid to be drawn in through the suction passage.

14. The oil pump of claim 6, wherein the opening and shutting member is positioned at an upper end of the supply passage which is coupled to the suction passage.

15. The oil pump of claim 1, wherein the upper suction unit includes:

a supply pipe configured to be inserted into a side of the pump body so as to form a supply passage;

a suction pipe which forms a suction passage coupled to the supply passage, wherein the suction passage couples a fluid storage area of the compressor to the supply passage; and an opening and shutting member configured to open and shut the supply passage.

16. The oil pump of claim 15, wherein a diameter of the suction pipe is greater than a diameter of the supply pipe, and wherein the opening and shutting member comprises a ball valve positioned where the supply pipe meets the suction pipe, wherein a specific gravity of a ball portion of the ball valve is less than that of fluid to be drawn into the suction passage and through the supply passage so that the ball ascends into the suction pipe as the fluid is drawn in.

17. The oil pump of claim 15, further comprising a cover coupled to the supply pipe, wherein the cover includes at least one intake.

18. The oil pump of claim 15, wherein the suction pipe has at least one intake.

19. The oil pump of claim 15, wherein the opening and shutting member has a lighter specific gravity than that of oil in the fluid storage area.

20. The oil pump of claim 15, wherein the opening and shutting member is positioned at an upper end of the supply passage which is coupled to the suction passage.

21. A scroll compressor comprising the oil pump of claim 1.

22. An oil pump for a compressor including a casing having a fluid storage area formed therein, the oil pump comprising:

a pump body;

a drive shaft which extends through the pump body;

a pumping member coupled to the pump body so as to define a pumping part therebetween;

a lower suction unit provided on a lower side of the pump body, wherein the lower suction unit draws fluid stored in the storage area into the oil pump and supplies the fluid to the pumping part through at least one passage formed in the lower suction unit; and an upper suction unit provided on the pump body wherein the upper suction unit draws fluid stored in the storage area into the oil pump and supplies the fluid to the pumping part.

23. The oil pump of claim 22, wherein the fluid drawn in by the upper and lower suction units is oil, refrigerant, or a mixture thereof.

24. The oil pump of claim 22, wherein the upper suction unit includes:

a supply passage connected to the pumping part;

a suction passage having a larger cross sectional area than that of the supply passage;

a cover configured to cover the suction passage, wherein the cover has at least one intake; and an opening and shutting member configured to selectively open and shut the supply passage.

25. The oil pump of claim 24, wherein a portion of the cover is configured to be inserted into the suction passage so as to couple the cover to the suction passage.

26. The oil pump of claim 24, wherein the cover is configured to be coupled to an upper side of the pump body.

27. A scroll compressor comprising the oil pump of claim 22.

28. An oil pump for a compressor including a casing having a fluid storage area formed therein, the oil pump comprising:

a pump body;

a drive shaft which extends through the pump body;

a pumping member coupled to the pump body so as to define a pumping part therebetween, wherein the pumping member is configured to rotate as the drive shaft rotates;

a lower suction unit provided on a lower side of the pump body, wherein the lower suction unit supplies fluid stored in the storage area to the pumping part through at least one passage formed in the lower suction unit; and an upper suction unit provided on a side of the pump body, wherein the upper suction unit supplies fluid stored in the storage area to the pumping part through at least one passage formed in the upper suction unit.

29. The oil pump of claim 28, wherein the fluid is oil, a refrigerant, or a mixture thereof.

30. The oil pump of claim 28, wherein the upper suction unit includes:

a supply pipe inserted into a side of the pump body so as to form a supply passage;

a suction pipe which forms a suction passage coupled to the supply passage, wherein the suction pipe has a larger diameter than that of the supply pipe;

an opening and shutting member configured to open and shut the supply passage; and a cover having at least one intake, wherein an end portion of the cover is configured to be inserted into the suction pipe so as to couple the cover and the suction pipe.

31. The oil pump of claim 28, wherein the upper suction unit includes:

a supply pipe inserted into a side of the pump body so as to form a supply passage;

a suction pipe which forms a suction passage coupled to the supply passage, wherein the suction pipe has a larger diameter than that of the supply pipe, and wherein the suction pipe has at least one intake formed in an exposed portion thereof and an opening and shutting member configured to open and shut the supply passage.

32. An oil pump for a compressor, comprising:

a pump body coupled to a drive shaft;

a pumping member coupled to the pump body so as to define a pumping part therebetween;

a pump cover coupled to a lower side of the pump body, the pump cover including a lower suction unit having at least one passage formed therein; and an upper suction unit positioned above the lower suction unit, the upper suction unit having at least one passage formed therein, wherein the upper suction unit comprises:

a supply passage connected to the pumping part;

a suction passage which couples a fluid storage area of the compressor to the supply passage;

a cover configured to cover the suction passage, wherein the cover includes at least one intake; and an opening and shutting member configured to selectively open and shut the supply passage.

* * * * *